US005337059A

United States Patent [19]

Kölzer et al.

[11] Patent Number: 5,337,059

[45] Date of Patent: Aug. 9, 1994

[54] APPARATUS AND METHOD FOR DETERMINING THE APERTURE ILLUMINATION OF A PHASED-ARRAY ANTENNA

[75] Inventors: Peter Kölzer, Korntal-Münchingen; Rolf-Hans Mundt, Ditzingen, both of Fed. Rep. of Germany

[73] Assignee: Alcatel Sel Aktiengesellschaft, Stuttgart, Fed. Rep. of Germany

[21] Appl. No.: 110,364

[22] Filed: Aug. 23, 1993

[30] Foreign Application Priority Data

Aug. 22, 1992 [DE] Fed. Rep. of Germany ..... 4227857

[51] Int. Cl.[5] ..... H01Q 3/00

[52] U.S. Cl. ..... 342/360; 342/173

[58] Field of Search ..... 342/360, 173, 174, 351

[56] References Cited

U.S. PATENT DOCUMENTS 4,453,164 6/1984 Patton .
4,536,766 8/1985 Frazita .
4,926,186 5/1990 Kelly et al. .
5,187,486 2/1993 Kölzer .

FOREIGN PATENT DOCUMENTS

0452799A1 10/1991 European Pat. Off. .
4012101 10/1991 Fed. Rep. of Germany .

OTHER PUBLICATIONS

J. R. Sebring and J. K. Ruth, "MLS Scanning-Beam Antenna Implementation", Jan. 1974, pp. 41–44 and 46, Microwave Journal.

Jacob Ronen and Richard H. Clarke, "Monitoring Techniques for Phased-Array Antennas", Dec. 1985, pp. 1313–1327, IEEE Transactions on Antennas and Propagation, vol. AP-33, No. 12.

*Primary Examiner*—Theodore M. Blum
*Attorney, Agent, or Firm*—Frishauf, Holtz, Goodman & Woodward

[57] ABSTRACT

An apparatus and method are disclosed for determining an aperture illumination of a phased-array antenna. The apparatus and method evaluate a monitor signal obtained from a first output (A1) of a monitor waveguide (MH). The apparatus and method are also suited for antennas having a very restricted scan angle coverage, such as elevation antennas in MLS systems. To obtain information from a portion of the monitor signal corresponding to at least one cycle of the far-field pattern of the antenna, portions of the monitor signal which are visible at different monitor angles are combined for evaluation. This is accomplished by also evaluating signals obtained from a second output (A2) of the monitor waveguide which is spatially separated from the first output (A1), or from outputs of additional monitor waveguides, at different monitor angles.

10 Claims, 4 Drawing Sheets

APPARATUS AND METHOD FOR DETERMINING THE APERTURE ILLUMINATION OF A PHASED-ARRAY ANTENNA

BACKGROUND OF THE INVENTION

1. Field of the Invention

The present invention relates to an apparatus and a method for determining an aperture illumination of a phased-array antenna which includes a plurality of radiating elements coupled via coupling apertures to at least one integral monitor waveguide and wherein a signal-conditioning circuit is connected to a first output of the integral monitor waveguide for determining at least one real part and any existing imaginary parts, of a time-dependent complex monitor signal provided by the integral monitor waveguide, the signal-conditioning circuit feeding the at least one real part and the any existing imaginary parts of the complex monitor signal to a signal processing circuit having a signal processor therein for continuously calculating the aperture illumination of the phased-array antenna from the real and imaginary parts of the complex monitor signal determined by the signal-conditioning circuit.

2. Description of the Prior Art

The apparatus described above, is known from both U.S. Pat. Nos. 5,187,486 and 4,926,186, the entire contents of which are incorporated herein by reference. This known apparatus is used, for example, to monitor phased-array antennas in microwave landing systems (MLS systems).

In MLS systems it is important for safety reasons to constantly monitor the correct operation of the transmitting devices, particularly the functioning of the individual radiating elements of the phased-array antenna. In older MLS systems, this is done, for example, by monitoring currents which flow through PIN diodes connected as phase shifters ahead of the individual radiating elements.

In the apparatus described in U.S. Pat. Nos. 4,926,586 and 5,187,486 mentioned above, the distribution of the far-field of the phased-array antenna is monitored in addition to the diode current. Since the far-field is linked with the aperture illumination of the antenna via a Fourier transform, far-field monitoring makes it possible to detect deviations in both the aperture phase illumination and the aperture amplitude illumination of the individual radiating elements.

In addition to direct far-field measurements, the distribution of the far-field of a phased-array antenna can be determined by means of a so-called integral monitor waveguide, a waveguide component which is arranged parallel to the array axis in the vicinity of the radiating elements and is coupled with the radiation fields of the individual radiating elements via coupling apertures. In such an integral monitor waveguide, the field components from the individual radiating elements are combined to form a time-dependent complex monitor signal which can be obtained as an output of the integral monitor waveguide and whose waveform, if the scan angle of the antenna beam is sufficiently large, corresponds, to a good approximation, of the far-field pattern except for an angular displacement with respect to the normal that is perpendicular to the array axis, i.e., this is the so-called monitor angle. The complex monitor signal has a real part and may have one or more imaginary parts (see U.S. Pat. No. 5,187,486, column 3, lines 6–43 and U.S. Pat. No. 4,926,186, column 8, lines 4–8 and 46–53 and column 9, lines 12–29).

The monitor angle, by which the monitor signal is shifted with respect to the normal to the array axis, can be influenced within certain limits by the dimensions of the integral monitor waveguide and by the shape of the coupling apertures. The monitor angle can be taken into account in calculating the aperture illumination of the antenna, so that this calculation, despite the displacement of the monitor signal by the monitor angle, can be made from this monitor signal by way of a Fourier transform.

A prerequisite for a good match between the monitor signal derived from the integral monitor waveguide and the far-field pattern of the antenna, and thus for a correct calculation of the aperture illumination of the antenna, requires that the antenna be scanned through a sufficiently large angular range. This angular range should cover at least one full cycle of the far-field pattern, so that field information of one complete cycle of the far-field pattern is available for performing the Fourier transform.

In most cases, however, MLS antennas have a restricted scan angle which frequently covers only a fraction of one cycle of the far-field pattern. In such cases, the Fourier transformation of the monitor signal becomes erroneous and, thus, unsuitable. Correction of errors due to use of too small a scan angle can be performed by use of a window function as proposed in the above-mentioned U.S. Pat. No. 4,926,186 in column 9, lines 34–42, which, however, provides no fundamental remedy for the problem of use of too small a scan angle. The use of a window function may possibly only be useful if the scan angle is very much less than one cycle of the far-field pattern.

SUMMARY OF THE INVENTION

It is, therefore, the object of the invention to improve an apparatus and a method for determining an aperture illumination of a phased-array antenna in such a way that a sufficiently accurate calculation of the aperture illumination of the phased-array antenna can be obtained by using an integral monitor waveguide even for antennas with a very restricted scan angle coverage.

In the present invention, a second output of the integral monitor waveguide is provided. The second output is spatially separated from a first output. An additional evaluation of the complex monitor signal is provided at the second output so that the scan angle coverage needed to calculate the aperture illumination is, in the best case, doubled. If the two outputs are provided at opposite ends of the integral monitor waveguide, then the first output will provide a monitor signal which only contains information from a region of the far-field pattern that corresponds to the width of the scan angle. The position of this information-providing, i.e., "visible" region within the far-field pattern is determined by the monitor angle $\theta$. The second output provided at the other end of the integral monitor waveguide will provide a monitor signal which also contains only information from a region of the far-field pattern which corresponds to the width of the scan angle. However, this region is visible at a different monitor angle, namely the angle $-\theta$, and is located symmetrically with respect to 0°, and the perpendicular bisector on the array axis. If the scan angle is not too small, with the present invention, it is now possible to utilize the monitor signals obtained from the two outputs of the integral monitor waveguide, or conditioned parts thereof, in a mutually complementary manner. If the visible regions can be so adjusted in position and width so as to cover together only one cycle of the far-field pattern, an accurate calculation of the aperture illumination of the antenna can be performed. In extreme cases, e.g., in the case of MLS elevation antennas, the scan angle is so small (e.g., only 15°) that even if the monitor signal obtained from a second output of the integral monitor waveguide is additionally evaluated, no visible region corresponding to a full cycle of the far-field pattern can be composed.

In this case, according to a further advantageous aspect of the present invention, use can be made of one or more additional integral monitor waveguides whose monitor angles are adjusted so that the associated visible regions of the far-field pattern as a whole, covers those angular ranges of a cycle which are not covered by the visible regions of the first integral monitor waveguide.

BRIEF DESCRIPTION OF THE DRAWINGS

Embodiments of the apparatus according to the present invention will now be described with reference to the accompanying drawings, in which.

DETAILED DESCRIPTION

Figure 1:
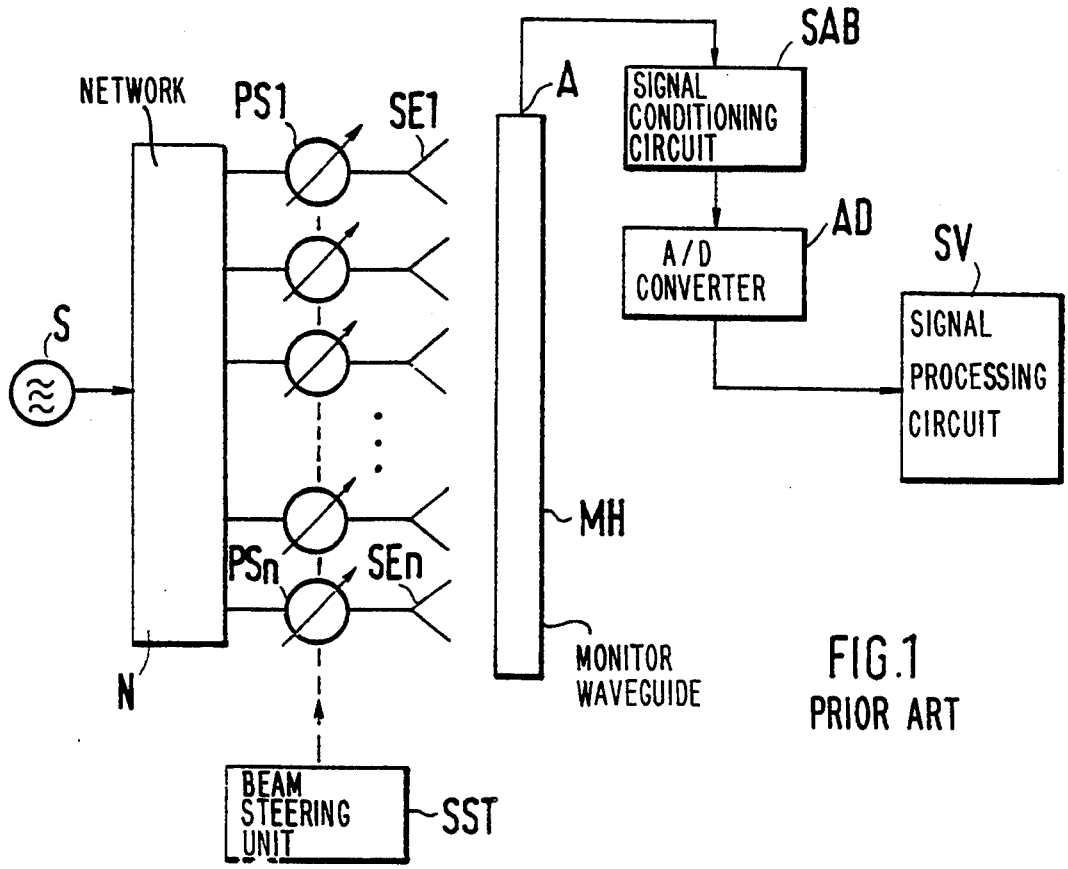
FIG.1 PRIOR ART
FIG. 1 shows schematically a prior art apparatus for determining the aperture illumination.

FIG. 1 shows schematically a prior art apparatus for determining the aperture illumination of an MLS array antenna. A transmitter S feeds a number of radiating elements SE1 . . . SEn via a network N. The radio-frequency energy is supplied to the radiating elements through phase shifters PS1 . . . PSn, that are generally PIN diodes, which precede the individual radiating elements. The PIN diodes are activated at predetermined times by a beam-steering unit SST, and each PIN diode is set to a predetermined phase shift.

Disposed in the vicinity of the radiating elements SE1–SEn, parallel to the array axis, is an integral monitor waveguide MH having coupling apertures (not shown) each of which is on a level with one of the radiating elements. The output A of the integral monitor waveguide MH is connected via a signal-conditioning circuit SAB and a subsequent analog-to-digital converter AD to a signal processing circuit SV. The signal processing circuit contains a high-speed signal processor which is capable of performing mathematical operations, such as fast Fourier transforms, in real time.

Figure 2:
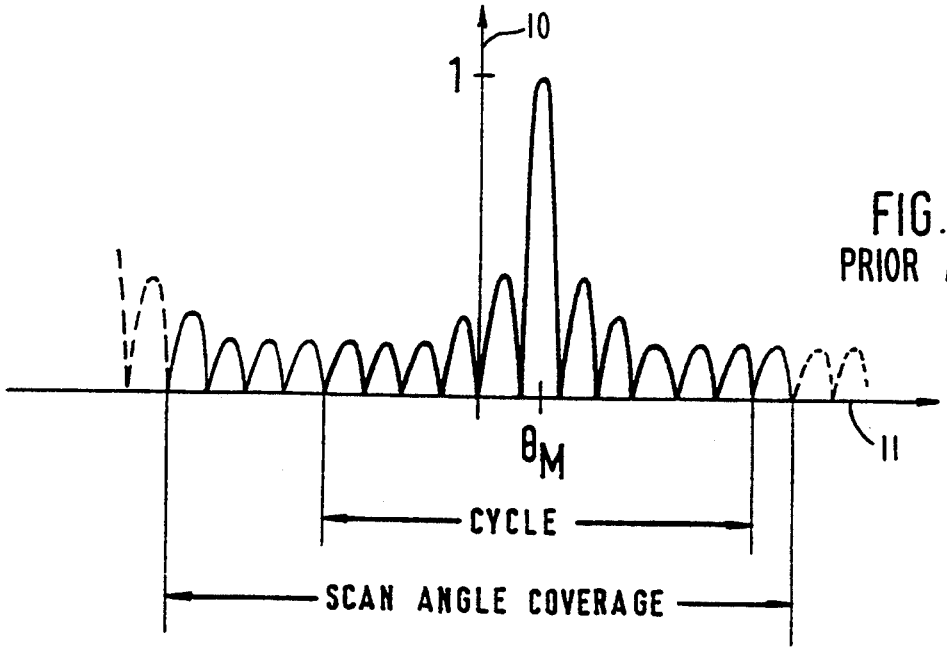
FIG.2 PRIOR ART
FIG. 2 shows a monitor signal derived with the apparatus of FIG. 1.

The prior art apparatus illustrated in FIG. 1 evaluates a monitor signal which is shown in FIG. 2. This signal is formed in the integral monitor waveguide MH by superposition of the components of the MLS signal being transmitted which originate from the individual radiating elements, and which are coupled through the coupling apertures into the waveguide MH, and have different phase shifts. The monitor signal obtained from the output A of FIG. 1 is plotted on axes 10 and 11 and corresponds to the far-field pattern of the MLS antenna except for an angular displacement with respect to the normal to the array axis, and the monitor angle $\theta_M$. Like the far-field pattern, the aperture illumination of the antenna can thus also be calculated from this monitor signal via a Fourier transform, and predetermined test values can be compared with stored desired values to monitor the correct functioning of the transmitting device. Various methods for signal-conditioning and calculating the aperture illumination are described in the above-mentioned U.S. Pat. No. 5,187,486.

To calculate the aperture illumination from the far-field pattern, or from the monitor signal derived by means of the integral monitor waveguide MH via a Fourier transform, measured or sample values from at least one whole cycle of the far-field or of a monitor signal corresponding to this far-field must be available. This will not be the case if the scan angle of the antenna is less than the angular range covered by one cycle of the far-field pattern. Then the aperture illumination calculated via a Fourier transform will not correspond to the actual illumination and will thus be unsuitable.

Figure 3:
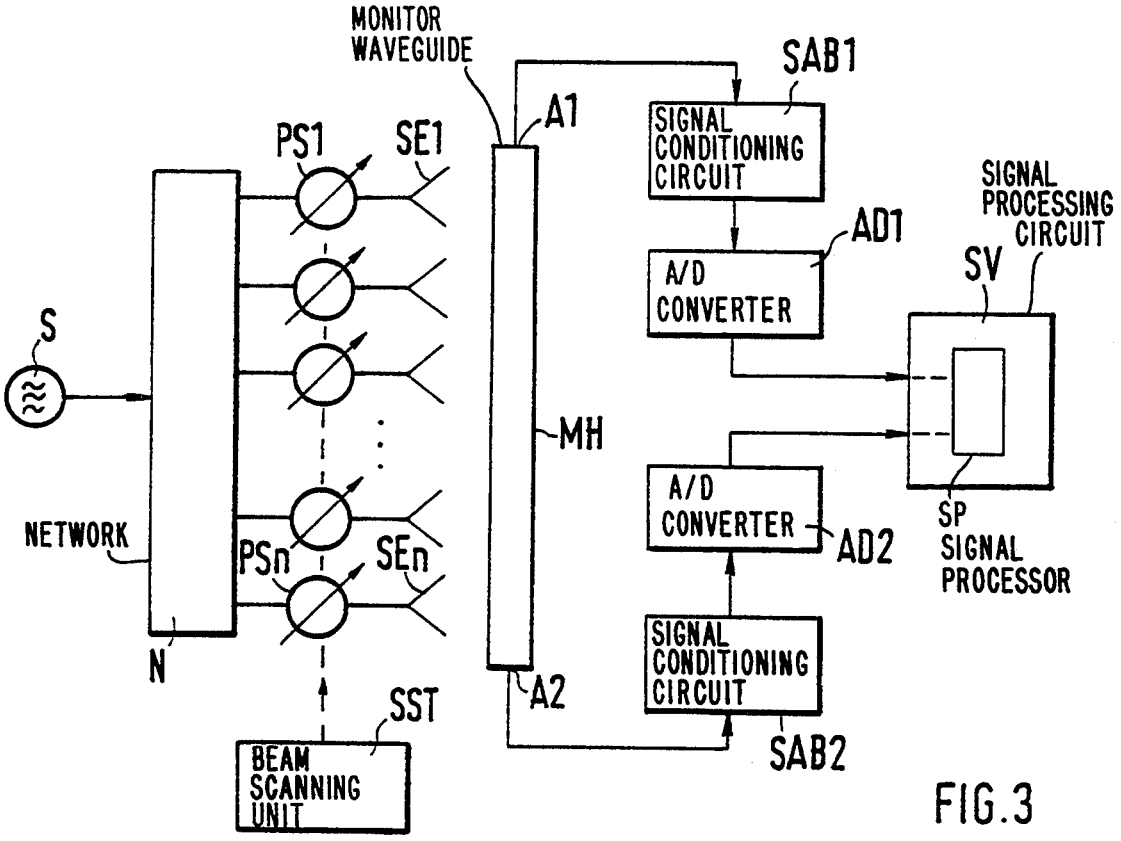
FIG. 3 shows schematically an apparatus for determining the aperture illumination in accordance with the invention.
Figure 4A:
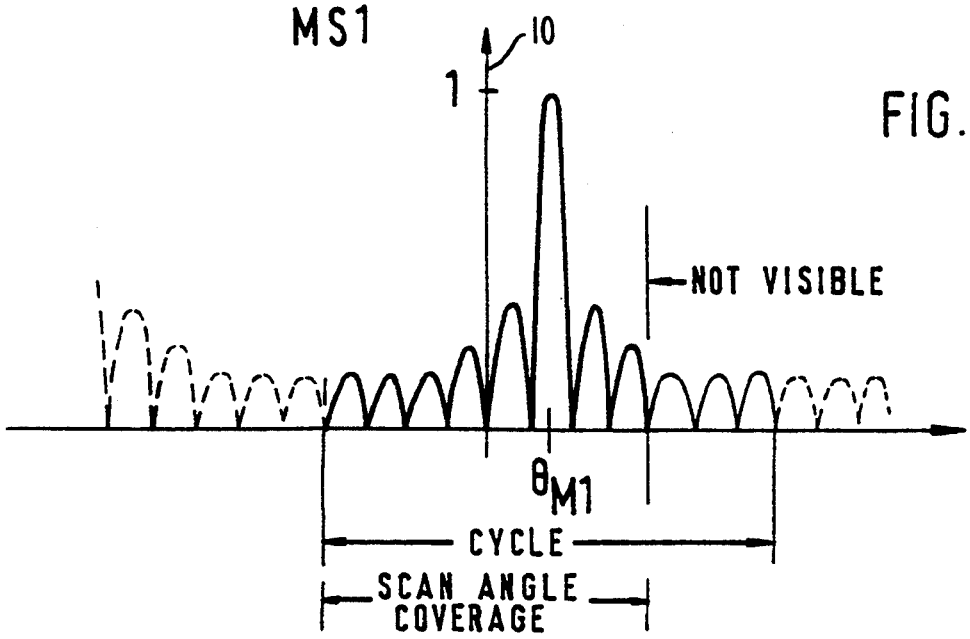
FIGS. 4A and 4B respectively show the monitor signals at A1 and A2 (of FIG. 3) derived with the apparatus of FIG. 3.
Figure 4B:
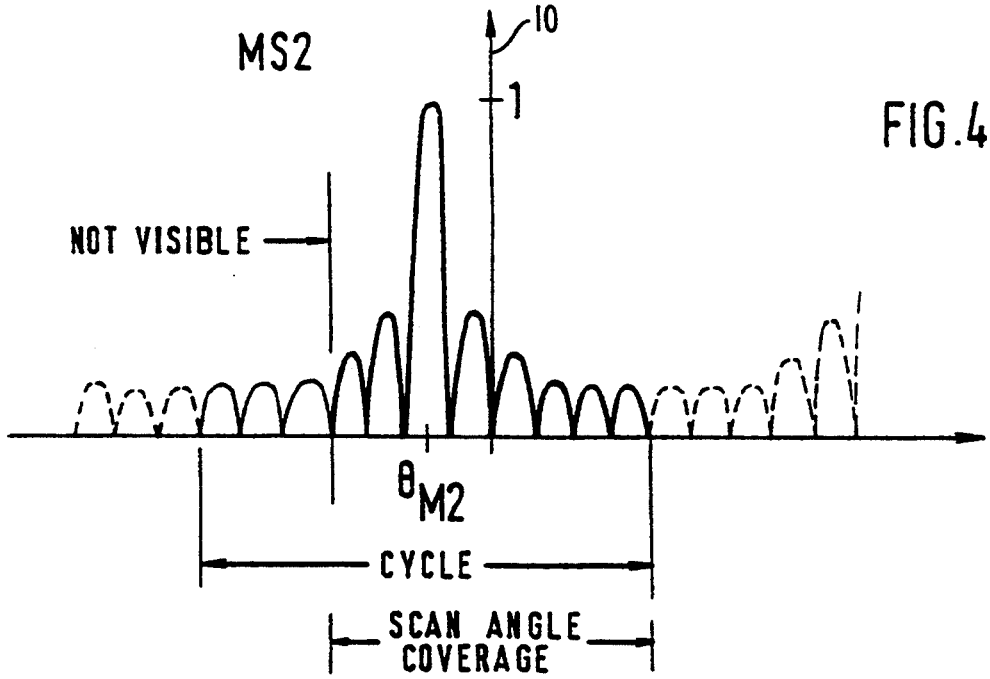

In FIG. 3, unlike in the prior art arrangement shown in FIG. 1, the integral monitor waveguide MH has two output terminals A1 and A2 positioned respectively on the ends thereof. Each of the outputs is respectively connected to a respective signal-conditioning circuit SAB1, SAB2 which respectively apply a conditioned monitor signal through a respective analog-to-digital converter AD1, AD2 to a signal processing circuit SV. The monitor signals MS1, MS2 provided at the outputs A1 and A2 differ in their monitor angle $\theta_M$. At the different monitor angles, different portions MS1, MS2 of the composite monitor signal corresponding to the far-field pattern are visible if the scan angle coverage is restricted. The width of the respective visible portions correspond to the scan angle coverage of the antenna as shown in FIGS. 4A and 4B:

In FIG. 4A, the monitor signal MS1 from the output A1 appears at a monitor angle $\theta_{M1}$ from the center of the antenna (perpendicular bisector on the array axis 10), i.e., displaced to the right. Thus, portions of the one-cycle-wide composite monitor signal required to calculate the aperture illumination which are located on the right-hand side remain invisible. By contrast, the left-hand signal side is visible up to the beginning of the cycle. In the case of the monitor signal MS2 from the output A2 in FIG. 3, which is shown in FIG. 4B, the monitor angle $\theta_{M2}$ is located symmetrically with respect to that of the monitor signal MS1, i.e., displaced to the left of the antenna center which coincides with axis 10. The visible portion covered by the monitor signal thus covers components of the total monitor signal which extend to the right-hand border of the signal cycle, while at the left-hand edge of the signal cycle, signal components remain invisible. From FIGS. 4A and 4B it can be seen that the monitor signals MS1 and MS2 together contain the whole information of one cycle of the monitor signal. The sample values required to calculate the aperture illumination can thus be derived from the two monitor signals if the different monitor angles are taken into account as numerical values.

In special cases, e.g., in the case of elevation antennas which scan through an angle of only 15°, doubling the visible portion of the composite monitor signal by deriving an additional monitor signal at a mirrored monitor angle will not be sufficient to make the composite monitor signal corresponding to a whole cycle of the antenna's far-field visible. To obtain information for a whole cycle of the monitor signal in this case, too, the embodiment illustrated in FIG. 5 includes a second integral monitor waveguide MH2 which also provides monitor signals at two outputs located at opposite ends thereof. The monitor angle of an integral monitor waveguide can be influenced and set by the design of the waveguide and by the position and shape of the coupling apertures. Adjusting the setting of the monitor angle permits different portions of a one-cycle-wide monitor signal which are not made visible by use of one monitor waveguide, to be made visible by use of at least one additional integral monitor waveguide MH2 which can be used to add to the visible portions of this one-cycle-wide monitor signal.

Figure 5:
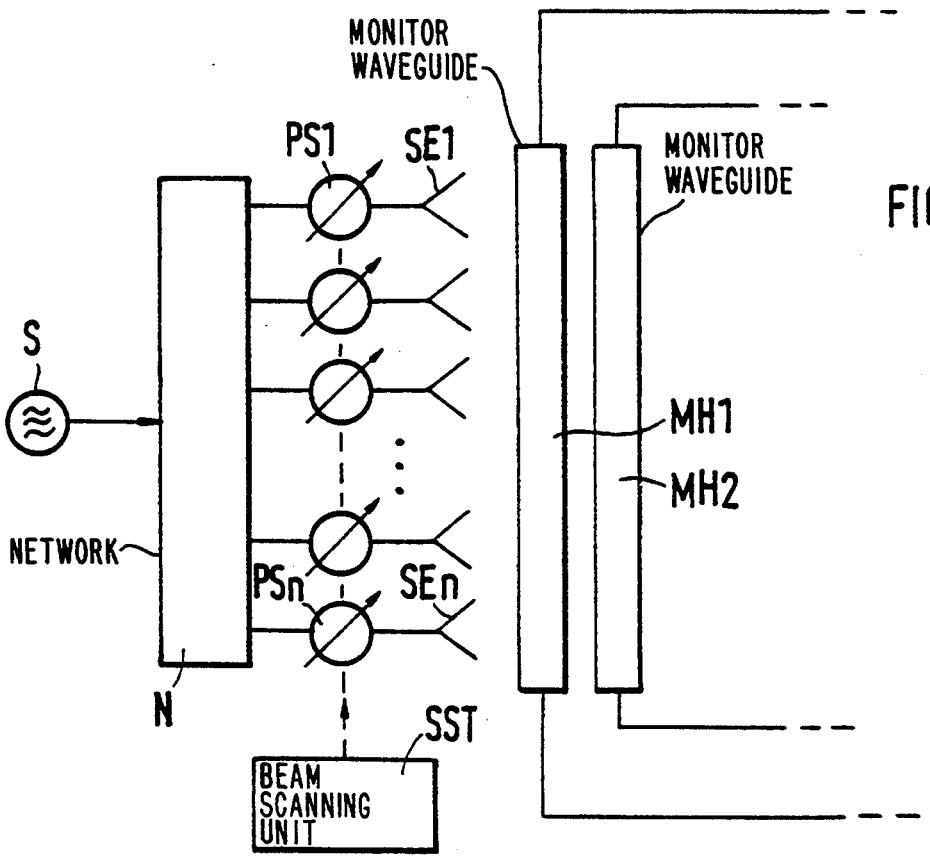
FIG. 5 shows schematically a further apparatus in accordance with the invention.
Figure 6:
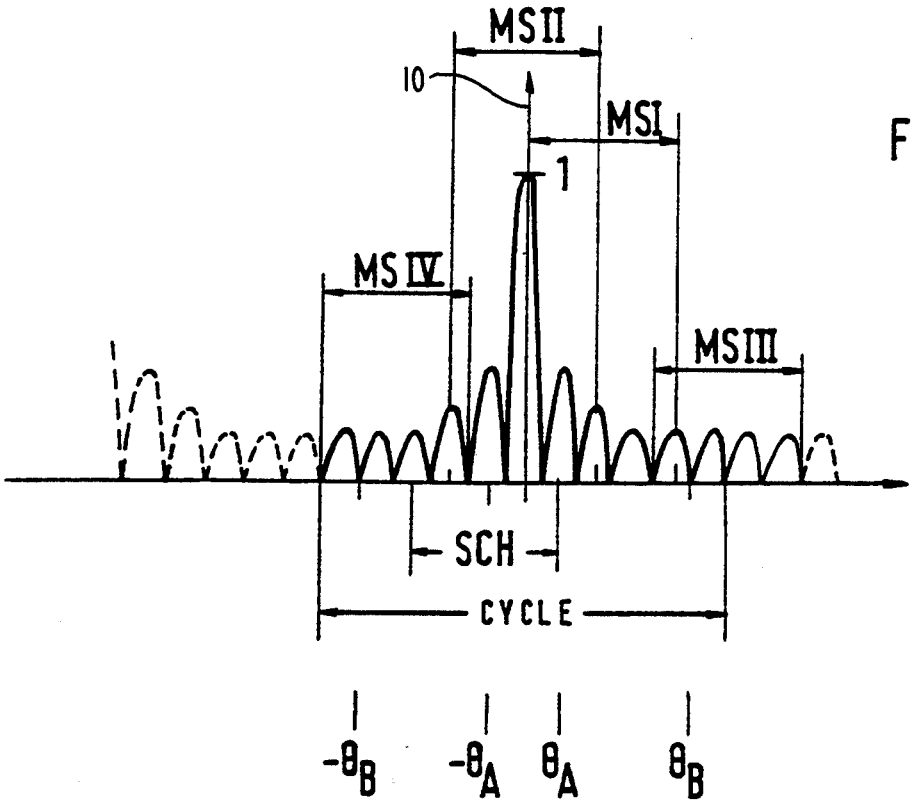
FIG. 6 shows a composite monitor signal including four monitor signals that is obtainable using the apparatus of FIG. 5.

FIG. 6 shows how, in the case of an antenna with a very restricted scan range as shown in FIG. 5, coverage of a whole cycle of a composite monitor signal can be formed from four monitor signals MSI . . . MSIV each having a limited width and respectively having monitor angles of $\theta_A$, $-\theta_A$, $\theta_B$, $-\theta_B$.

Various changes and modifications may be made, and features described in connection with any one of the embodiments may be used with any of the others, within the scope of the inventive concept.

We claim:

1. Apparatus for determining an aperture illumination of a phased-array antenna, comprising:

a plurality of radiating elements (SE1 . . . SEn) respectively coupled via coupling apertures to at least one integral monitor waveguide (MH);

a first signal-conditioning circuit (SAB1) connected to a first output (A1) of said at least one integral monitor waveguide (MH), for determining at least one real part and any existing imaginary parts of a time-dependent complex monitor signal provided by said at least one integral monitor waveguide (MH);

said signal-conditioning circuit (SAB1) feeding said at least one real part and said any existing imaginary parts of said complex monitor signal to a signal processing circuit (SV) having a signal processor (SP) therein, for continuously calculating the aperture illumination of the phased-array antenna from said at least one real part and said any existing imaginary parts of said complex monitor signal determined by said first signal-conditioning circuit (SAB1);

said at least one integral monitor waveguide (MH of FIG. 3 or MH1, MH2 of FIG. 5) having a second output (A2) which is spatially separated from said first output (A1 of FIG. 3), said second output (A2) being connected to a second signal-conditioning circuit (SAB2 of FIG. 3) which determines said at least one real part and said any existing imaginary parts of said complex monitor signal that are provided at said second output (A2) of said at least one integral monitor waveguide (MH);

said first signal-conditioning circuit (SAB1) and said second signal-conditioning circuit (SAB2) respectively feeding at least said at least one real part of said complex monitor signal to said signal processing circuit (SV); and wherein:

said signal processing circuit (SV) further calculates from said at least one real part and said any existing imaginary parts of said complex monitor signal determined by said second signal-conditioning circuit (SAB2), the aperture illumination of the phased-array antenna.

2. The apparatus as claimed in claim 1, wherein said first and second outputs (A1, A2) are provided from first and second opposite ends of said at least one integral monitor waveguide (MH).

3. The apparatus as claimed in claim 1, wherein:

said at least one integral monitor waveguide (MH) comprises first (MH1) and second (MH2) integral monitor waveguides, which respectively have said first and second outputs (A1, A2);

said first integral monitor waveguide (MH1) provides a first complex monitor signal at said first and second outputs (A1, A2) thereof that is different from a second complex monitor signal provided at said first and second (A1, A2) outputs of said second integral monitor waveguide (MH2);

said second complex monitor signal of said second integral monitor waveguide (MH2) is coupled to said second signal-conditioning circuit (SAB2) which determines said at least one real part of said second complex monitor signal provided by the second integral monitor waveguide (MH2);

said second signal-conditioning circuit SAB2 feeding said at least one real part of said second complex monitor signal to said signal processor (SP); and said signal processor (SP) calculates from said real and said any existing imaginary parts of said second complex monitor signal determined by said second signal-conditioning circuit (SAB2), the aperture illumination of the phased-array antenna.

4. The apparatus as claimed in claim 3, wherein said second complex monitor signal produced by said second (MH2) integral monitor waveguide has a monitor angle that is different from a first monitor angle $\theta_M$ of the first complex monitor signal provided by the first (MH1) integral monitor waveguide.

5. The apparatus as claimed in claim 2, wherein:

said at least one integral monitor waveguide (MH) comprises first (MH1) and second (MH2) integral monitor waveguides, which respectively provide said first and second outputs (A1, A2);

said first integral monitor waveguide (MH1) provides a first complex monitor signal at said first and second outputs (A1, A2) thereof that is different from a second complex monitor signal provided at said first and second (A1, A2) outputs of said second integral monitor waveguide (MH2);

said second complex monitor signal of said second integral monitor waveguide (MH2) is coupled to said second signal-conditioning circuit (SAB2) which determines at least said at least one real part of said second complex monitor signal provided by the second integral monitor waveguide (MH2);

said second signal-conditioning circuit SAB2 feeding at least said one real part of said second complex monitor signal to said signal processor (SP); and said signal processor (SP) calculates from said real and said any existing imaginary parts of said second complex monitor signal determined by said second signal-conditioning circuit (SAB2), the aperture illumination of the phased-array antenna.

6. The apparatus as claimed in claim 5, wherein said second complex monitor signal produced by said second (MH2) integral monitor waveguide has a monitor angle that is different from a first monitor angle $\theta_M$ of the first complex monitor signal provided by the first (MH1) integral monitor waveguide.

7. In a method for determining an aperture illumination of a phased-array antenna having a plurality of radiating elements (SE1 . . . SEn) coupled via coupling apertures to at least one integral monitor waveguide (MH), the steps comprising:

providing first and second spatially separated outputs (A1, A2) from said at least one integral monitor waveguide (MH);

respectively connecting first and second signal-conditioning circuits (SAB1, SAB2) to said first and second outputs (A1, A2) of said at least one integral monitor waveguide (MH) for respectively determining at least one real part and any existing imaginary parts of a time-dependent complex monitor signal which is provided by said at least one integral monitor waveguide (MH) at each of said first and second outputs (A1, A2) thereof;

said time-dependent complex monitor signal provided at each of said first (A1) and second (A2) outputs being identical to each other except for a sign of a respective monitor angle $\theta_M$ thereof; and feeding said at least one real part and said any existing imaginary parts of said complex monitor signal determined by said first and second signal-conditioning circuits (SAB1, SAB2) to a signal processing circuit (SV) having a signal processor (SP) therein, for continuously calculating the aperture illumination of said phased-array antenna from said real and said any existing imaginary parts of said complex monitor signal determined by said first and second signal-conditioning circuits (SAB1, SAB2).

8. The method as claimed in claim 7, wherein:

said at least one integral monitor waveguide (MH) comprises first (MH1) and second (MH2) integral monitor waveguides that respectively have said first (A1) and said second (A2) outputs;

said first complex monitor signal provided at the first and second outputs (A1, A2) of said first (MH1) integral monitor waveguide (MH1) being identical to each other except for a sign of a first respective monitor angle $\theta_M$ thereof;

said second complex monitor output signal provided at the first and second outputs (A1, A2) of said second integral monitor waveguide (MH2) being identical to each other except for a sign of a second respective monitor angle thereof;

said second complex monitor signal provided by said second (MH2) integral monitor waveguide having said second monitor angle that is different from $\theta_M$ of the first complex monitor signal provided by said first (MH1) integral monitor waveguide;

said method further comprising the steps of:

respectively connecting said first and second (A1, A2) outputs of each of said integral monitor waveguides (MH1, MH2) to a respective one of said first and second (SAB1, SAB2) signal-conditioning circuits for respectively determining said at least one real part and said any existing imaginary parts of said first and second complex monitor signals provided thereto by the respective integral monitor waveguides (MH1, MH2);

feeding the at least one real part of the first and second complex monitor signals determined by the first and second (SAB1, SAB2) signal-conditioning circuits to the signal processor (SP); and then processing the at least one real and said any existing imaginary parts of said first and second complex monitor signals determined by said first and second signal-conditioning circuits (SAB1, SAB2), to calculate the aperture illumination.

9. The method as claimed in claim 7, further comprising:

positioning the first and second outputs (A1 and A2) of the integral monitor waveguide (MH) at first and second opposite ends of said at least one integral monitor waveguide.

10. The method as claimed in claim 9, wherein:

said at least one integral monitor waveguide (MH) comprises first (MH1) and second (MH2) integral monitor waveguides that respectively have said first (A1) and said second (A2) outputs;

said first complex monitor signal provided at the first and second outputs (A1, A2) of said first (MH1) integral monitor waveguide (MH1) being identical to each other except for a sign of a first respective monitor angle $\theta_M$ thereof;

said second complex monitor output signal provided at the first and second outputs (A1, A2) of said second integral monitor waveguide (MH2) being identical to each other except for a sign of a second respective monitor angle thereof;

said second complex monitor signal provided by said second (MH2) integral monitor waveguide having said second monitor angle that is different from $\theta_M$ of the first complex monitor signal provided by said first (MH1) integral monitor waveguide;

said method further comprising the steps of:

respectively connecting said first and second (A1, A2) outputs of each of said integral monitor waveguide (MH1, MH2) to a respective one of said first and second (SAB1, SAB2) signal-conditioning circuits for respectively determining said at least one real part and said any existing imaginary parts of said first and second complex monitor signals provided thereto by the respective integral monitor waveguides (MH1, MH2);

feeding the at least one real part of the first and second complex monitor signals determined by the first and second (SAB1, SAB2) signal-conditioning circuits to the signal processor (SP); and then processing the at least one real and said any existing imaginary parts of said first and second complex monitor signals determined by said first and second signal-conditioning circuits (SAB1, SAB2), to calculate the aperture illumination.

* * * * *

UNITED STATES PATENT AND TRADEMARK OFFICE

CERTIFICATE OF CORRECTION

PATENT NO. : 5,337,059
DATED : August 9, 1994
INVENTOR(S) : KOLZER et al.

It is certified that error appears in the above-identified patent and that said Letters Patent is hereby corrected as shown below:

Title page, Item [56] References Cited,
under "FOREIGN PATENT DOCUMENTS", insert:
--0126626 11/1984 Europe--

Signed and Sealed this

Seventeenth Day of March, 1998

*Attest:*

*Attesting Officer*

BRUCE LEHMAN

*Commissioner of Patents and Trademarks*